US006398612B2

(12) United States Patent
Gudger

(10) Patent No.: US 6,398,612 B2
(45) **Date of Patent: *Jun. 4, 2002**

(54) CONSTRUCTION TOY INTERCONNECTOR

(76) Inventor: Keith H. Gudger, P.O. Box 336, Soquel, CA (US) 95073

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/268,816

(22) Filed: Mar. 16, 1999

(51) Int. Cl.[7] ..... A63H 33/08

(52) U.S. Cl. ..... 446/125; 446/124; 446/126; 446/85; 446/108; 446/114

(58) Field of Search ..... 446/128, 126, 446/124, 120, 122, 116, 125, 108, 112, 111, 113, 114; 52/379, 428, 603, 604, 608, 107, 121

(56) References Cited

U.S. PATENT DOCUMENTS

| | | | | | |
|---|---|---|---|---|---|
| 1,198,263 | A | * | 9/1916 | Pajeau | 446/125 |
| 2,208,049 | A | * | 7/1940 | Pajeau | 446/126 |
| 2,709,318 | A | * | 5/1955 | Benjamin | 446/124 |
| 3,233,358 | A | * | 2/1966 | Dehm | 446/128 |
| 3,391,824 | A | * | 7/1968 | Wiseman | 446/125 |
| 3,597,875 | A | * | 8/1971 | Christiansen | 446/128 |
| 3,603,026 | A | * | 9/1971 | Kishigami | 446/128 |
| 3,640,017 | A | * | 2/1972 | Christiansen | 446/128 |
| 3,716,939 | A | * | 2/1973 | Pibet | 446/128 |
| 4,326,354 | A | * | 4/1982 | Hagberg | 446/126 |
| 4,403,733 | A | * | 9/1983 | Bach et al. | 446/128 |
| 4,744,780 | A | * | 5/1988 | Volpe | 446/128 |
| 4,902,259 | A | * | 2/1990 | Ziegler | 446/125 |
| 4,919,635 | A | * | 4/1990 | Bertrand | 446/128 |
| 4,964,833 | A | * | 10/1990 | Suzuki | 446/125 |
| 5,061,219 | A | | 10/1991 | Glickman | 446/126 |
| 5,238,438 | A | | 8/1993 | Glickman | 446/126 |
| 5,527,201 | A | | 6/1996 | Maddock | 446/104 |
| 5,562,519 | A | * | 10/1996 | Loewenton | 446/126 |
| 5,964,635 | A | | 10/1999 | Krog | 446/120 |
| 6,231,416 | B1 | * | 5/2001 | Clever et al. | 446/125 |

FOREIGN PATENT DOCUMENTS

| | | | | |
|---|---|---|---|---|
| FR | 1219634 | * | 5/1960 | 446/128 |
| FR | 77699 | * | 2/1962 | 446/128 |
| GB | 935308 | * | 8/1963 | 446/128 |
| GB | 1051087 | * | 12/1966 | 446/128 |

* cited by examiner

*Primary Examiner*—Jacob K. Ackun
*Assistant Examiner*—Urszula M Cegielnik
(74) *Attorney, Agent, or Firm*—Thomas Schneck

(57) ABSTRACT

A construction toy is disclosed which interconnects construction toys of different types. One version connects toys of the construction block type to toys of the hub and spoke type. Gripper posts (22) or gripper arms (34 and 46) on the interconnector create channels (24, 36 and 48, respectively) which receive a hub (40) from a hub and spoke construction toy. Spokes from the hub and spoke construction toy connect with the block toy at many different angles. Blocks from the block type construction toy connect normally on all faces of the base interconnector. Channels (24, 36 and 48) on the base allow variable hub (40) placement to accommodate the different sizes and spacings of the different toys. This invention maintains substantially all the possible connections of each toy after interconnection.

4 Claims, 3 Drawing Sheets

CONSTRUCTION TOY INTERCONNECTOR

BACKGROUND

1. Field of Invention

This invention relates to construction toys, specifically to interconnecting different types of construction toys.

BACKGROUND

2. Description of Prior Art

Construction toys of many different configurations are very well-known, pervasive, and popular. Construction toys generally fall into one of two categories: building block toys or hub and spoke toys. Building block construction toys take many different forms, and some of these are extremely well-known in association with their respective trademarks, for example LEGO™ and DUPLO™, manufactured by Lego Systems, Inc. Hub and spoke construction toys are also well known in association with their respective trademarks, for example Tinkertoy™, manufactured by Playskool Inc., a division of Hasbro, Inc., and K'NEX™, manufactured by K'NEX Industries, Inc. These toys employ various connection means that permit blocks to connect to other blocks or hubs to connect to spokes to build composite structures.

The numerous prior art building toys have many obvious attractions. However, the design of these toys does not allow interconnection with other types of toys. There are many reasons for this. One reason is that the block's or hub's design is optimal to permit them to connect with other components from the same toy. (Note: DUPLOs and LEGOs interconnect, however these are both block type construction toys and built using the same basic spacings.)

Each of the two types of construction toys has two types of structures: a round interconnecting post (32) or spoke, and a rectilinear receptacle, such as a block or hub. (While hubs are generally round, their sides or bases are usually flat. See FIG. 13.) In both cases "female" receptacles connect with "male" extensions. In the building block case the receptacle side (female) of a building block interlocks with the post side (male) of another block. In hub and spoke toys a hub (female) interlocks with (male) spokes or struts. Prior art interconnectors connected in the same way. This meant blocks could only connect at a fixed angle and position to struts or spokes of the hub and spoke toys. This posed several problems.

U.S. Pat. Nos. 5,061,219 and 5,238,438 to Joel I. Glickman, Oct. 29, 1991 and Aug. 24, 1993 respectively describe one example of an interconnector. The interconnector 50 in Glickman's patents (FIG. 10) is a block type toy with one receptacle 54 (female) for the male end of a spoke described in his patent. Spokes can only interconnect with these blocks at a perpendicular angle. The diameter of the spoke is larger than the diameter of the block's post (and the spacing between posts). This interconnector block can only connect with spokes, and not other blocks on side 52. This is because receptacle 54 is too large and there is no room left for block posts to fit on this side. The side with posts 56 connects only with blocks and not with spokes or hubs.

Construction toys have a basic spacing unit associated with them. In the case of block toys, the basic spacing is the distance between the posts' centers (the distance between the male connectors). Blocks are then multiples of this unit. Another term for this spacing unit is "pitch". The basic unit, or pitch, of hub and spoke toys is the distance between the centers of two hubs connected by the smallest spoke. The sizes of the larger spokes make the distance between hub centers either a multiple of this basic unit or a multiple of the square root of two times this basic unit.

One could envision a hub and spoke toy designed with its pitch a multiple of a block toy's pitch. However, this is not the case for the well-known toys mentioned in Glickman's patent. Their basic spacing units are not compatible. His interconnector does not address this issue.

Paul T. Maddock's U.S. Pat. No. 5,527,201, Jun. 18, 1996, (FIG. 11) describes another type of block interconnector 60. One block type described includes a connection of the LEGO type, thus describing an interconnector between two toy types. These blocks have one or more faces with apertures (female) defined to receive an elongated framing piece (male), such as a craft stick or a "tongue depressor". This block's aperture also only accepts a strut, and only a thin strut, not connectors or hubs from other toys. The aperture 62 does not provide for more than one direction or type of interconnection at each face. The aperture does not address the spacing differences between the two blocks. The framing piece that fits in this aperture is part of this toy set. The LEGO style interconnector block does not use this aperture and there is no adjustment for the differences in the block sizes of this toy and the LEGO block.

Both Glickman's and Maddock's interconnectors merely provide a connection to another type of toy. This is not enough. To build complex composite structures one needs a better interconnector. A better interconnector compensates for the differences in the toys; these patents' interconnectors do not. A better interconnector truly integrates the different toys; these patents' interconnectors do not.

OBJECTS AND ADVANTAGES

Accordingly, several objects and advantages of my invention are:

(a) to provide a method for interconnecting construction toys of different types, for example building block toys with hub and spoke toys;

(b) to provide a method for interconnecting construction toys which maintains substantially all the possible ways to connect each different toy type to its own parts;

(c) to provide an interconnection at many different angles;

(d) to provide an interconnection which is variable and accommodates the different spacing units and sizes of each toy;

(e) to provide a strong interconnection that permits variable placement.

One object and advantage of this invention is that struts can connect with blocks at many different angles. Another object and advantage is that this interconnector accommodates the different pitches and sizes of the two toys. A further object and advantage of this invention is that it maintains substantially all the possible connections of each toy after interconnection.

Further objects and advantages of my invention will become apparent from a consideration of the drawings and ensuing description.

SUMMARY

This invention interconnects construction toys of different types. One version connects construction block toys to construction toy hubs. In this way the spokes from the hub and spoke construction toy connect with the block toy at many different angles. This connector also accommodates the different spacing units and sizes of the two toys. This invention maintains substantially all the possible connections of each toy after interconnection.

DESCRIPTION OF INVENTION

Figure 1:
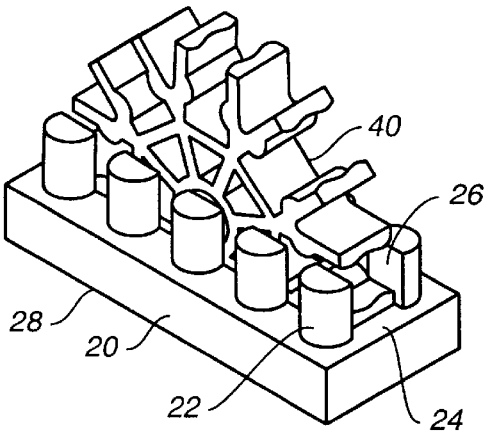
FIG. 1 is a perspective view of one embodiment of my invention, where a base connects to a block type construction toy and grips a hub of a well-known hub and spoke construction toy.
Figure 4:
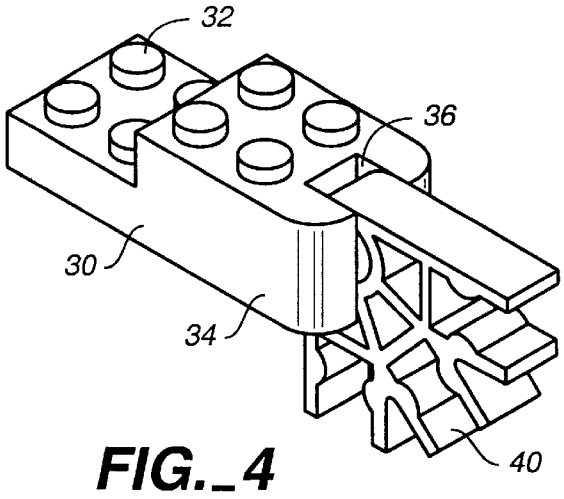
FIG. 4 is a perspective view of another embodiment of my invention, showing a base connecting to a block type construction toy and vertical gripper arms holding a hub of a well-known hub and spoke construction toy.
Figure 7:
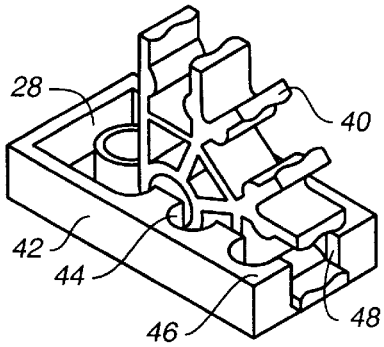
FIG. 7 is a perspective view of another embodiment of my invention, showing a base connecting to a block type construction toy and gripper arms formed into the base underside, holding a hub of a well-known hub and spoke construction toy.
Figure 10:
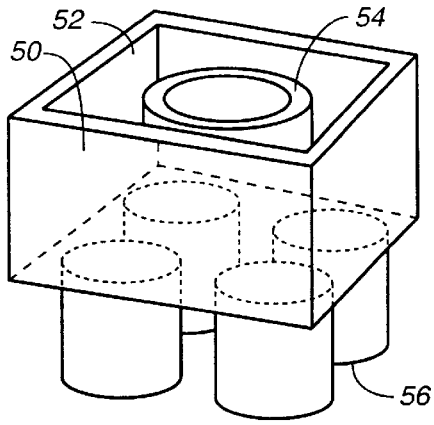
FIG. 10 (PRIOR ART)
FIG. 10 is a perspective view of a construction block toy with an interconnector for a spoke of a hub and spoke construction toy as described in U.S. Pat. Nos. 5,061,219 and 5,238,438 to Joel I. Glickman, Oct. 29, 1991 and Aug. 24, 1993 respectively.

FIGS. 1, 4 and 7 show perspective views of three basic versions of my interconnector. Note that these figures show a hub connector 40 from a well-known hub and spoke construction toy inserted into a gripping channel (24, 36 and 48, respectively). Hub connector 40 is not part of this invention.

The version of my invention in FIG. 1 is based on a well-known standard size construction toy block. A block 20 has a female connector 28 (FIG. 12*b*) on the bottom that is identical to the well-known block toy. The top of block 20 has posts 22 placed in the same positions as the well-known toy (compare to FIG. 12*a*). However, each post 22 in FIG. 1 has a semi-circular cross section. Each post 22 has a flat side 26. These flat sides 26 of two rows of posts face each other, forming channel 24. Channel 24's width is designed to hold firmly a hub 40 of another well-known hub and spoke construction toy.

Figure 2:
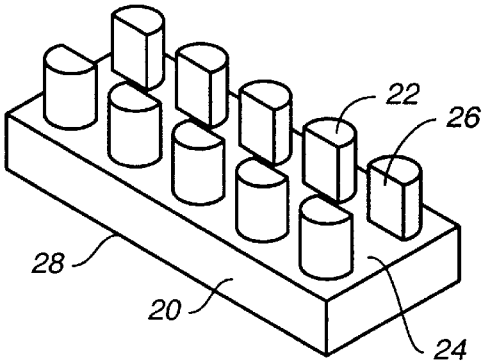
FIG. 2 is a perspective view of the same block as FIG. 1 without the hub.
Figure 3:
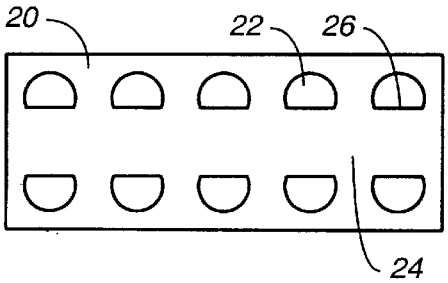
FIG. 3 is a top view of the same block as FIGS. 1 and 2.
Figure 6:
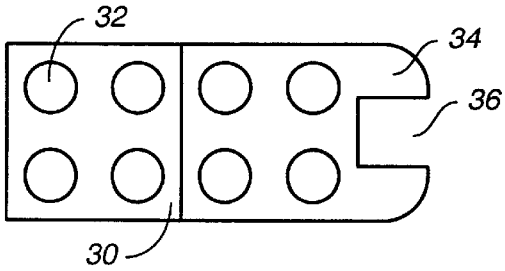
FIG. 6 is a top view of the same block as FIGS. 4 and 5.
Figure 13:
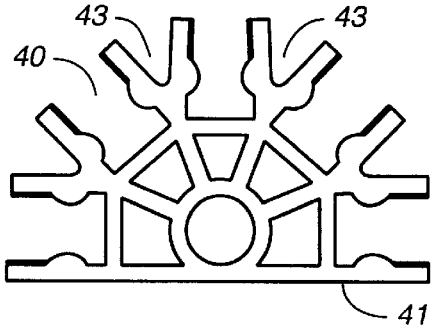
FIG. 13 (PRIOR ART)
FIG. 13 is a front view of a hub from a well-known hub and spoke construction toy.

The common description of the block size in FIGS. 1 through 3 is "2×5". This describes the top post layout in basic units. This block's length of 5 units is not a standard length. Block 20 is long enough to contain a 180 degree hub of the well-known hub and spoke toy (FIG. 13). As seen in FIG. 13, hub 40 has a track-like base 41 defining an edge with a plurality of spoke openings 43 in radial directions relative to the track-like base. However, many different block lengths are possible. Practical lengths include blocks from 2 to 6 units long. Wider blocks are also possible, although they are not generally available in this type of construction toy. The width of a one unit construction block is comparable to the width of a hub. A one unit width interconnector between these two toys would not have room to connect with the block toy on the gripping arms' side.

Figure 12A:
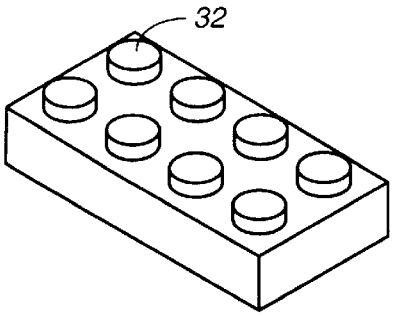
FIG. 12A (PRIOR ART)
FIG. 12*a* is a perspective view of a well-known block type construction toy.

FIG. 2 shows a perspective view of the same basic version of my interconnector as FIG. 1. This figure shows the interconnector block 20 without a hub 40 inserted. Note the height of posts 22. In this version of my invention posts 22 are approximately three to four times taller than a standard post (FIG. 12*a*). This post height is still short enough to fit inside standard height blocks. Longer posts provide a better gripping surface to hold hub 40. However, this is not necessary when there are many such posts as in FIGS. 1 through 3. The value of these longer posts is that they provide a larger gripping surface to the underside female connectors of the same construction toy blocks. This is useful because of the flat side 26 of the posts. The standard underside 28 of these construction blocks grips a standard post 32 in two to four places. Posts with a flat side 26 usually touch the underside of standard blocks in one less place, reducing the gripping force. Lengthening the post 22 compensates for this reduction in gripping area.

Note that this version of my invention still connects normally with standard construction toy blocks on all surfaces. The bottom 28 is unchanged from the standard block. The placement of top posts 22 is identical. The height and width of the block match the sizes of the standard block construction toy.

The version of my invention in FIG. 4 is based on a standard size construction toy block that is well-known. In this version block 30 has part of the block the standard height and part of the block twice the standard height. A block 30 of twice the height increases the length and surface area of a gripping channel 36. This increases the force with which gripping arms 34 grip hub Making a portion of block 30 a standard height enhances the connection of this block 30 with other blocks of the standard type block construction toy.

Note that this version of my invention still connects normally with standard construction toy blocks on all surfaces. The bottom is unchanged from the standard block. The top of the block and the placement of top posts 32 is identical (compare FIG. 6 to FIG. 12*a*). The height and width of the block match the sizes of the standard block construction toy. The one side of the block with gripper arms 36 obviously cannot fit directly up against other blocks. This is not a limitation in use, however, as a hub 40 is in channel 36. One then connects other pieces from the standard hub and spoke construction toy on this side of block 30.

The amount of gripping force required to hold hub 40 determines the depth and length of gripper arms 36. The surface area of a gripper arm 36 needs to be large enough to grip firmly hub 40. In this version of my invention the length of gripper arm 36 is two block's height. The height of gripper arm 36 is approximately one basic unit of the standard construction toy block wide. These sizes facilitate connection with other blocks of the well-known type.

This version of my invention has gripper arms 36 on the side of the block, while the previous version had gripper posts 22 on the top of the block. Side gripper arms 36 permit hubs 40 to connect struts to the side of and above and below the blocks. A block 30 can face either direction and interconnect in all four directions in this plane. Block 20 permits interconnection in three of the four directions in this plane. Hubs 40 permit connection with the standard hub and spoke construction toy components in directions out of the plane. Note also that blocks of the standard construction block toy type already permit placement at 90 degree angles, allowing interconnection in the third dimension.

The version of my invention in FIG. 7 is based on a standard size construction toy block that is well-known. In this version block 42 is a standard height, width and depth. This version of my invention connects normally with standard construction toy blocks on all surfaces. The top is unchanged from the standard block (FIG. 12*a*).

One end of the bottom of the block is of a standard type 28. There are modifications to a portion of the underside of the block. Instead of an open area, the area not required to mate with posts becomes gripper arms 46. Between the gripper arms 46 are circular regions 44 to mate with posts from other blocks. Opposing gripper arms 46 form a channel 48 that holds a hub connector 40.

This version of my invention has gripper arms 46 on the underside of a block, while the previous versions had gripper posts 22 on the top or gripper arms 36 on the side of blocks. Bottom gripper arms 46 permit hubs 40 to connect spokes to the bottom and sides of blocks. Hubs 40 permit connection with the standard hub and spoke construction toy components in directions out of the plane.

Clearly, one can place gripper arms on any of the six faces of construction blocks. The key is to provide these gripper arms in such a fashion as to not interfere with the standard methods for connecting blocks to one another.

Note that the gripping surfaces of the arms and posts do not have any "detents", channels or protrusions to strengthen their grip on the hubs. While detents would certainly increase the grip on the hubs, they would force a singular placement in the direction out of the channel. This would interfere with matching the different pitches or spacing units of the two toys in this direction.

The figures show one standard type of hub and spoke construction toy. Obviously many different types of hub and spoke construction toys can connect to block type construction toys, even though only one type is shown.

OPERATION OF INVENTION

Figure 5:
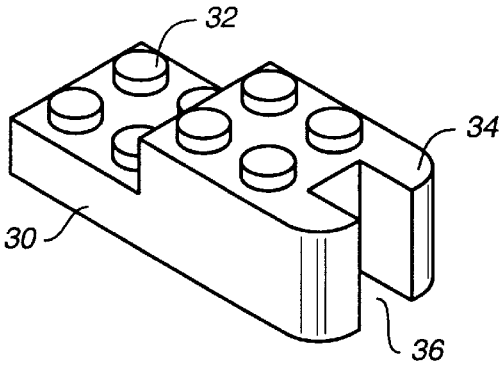
FIG. 5 is a perspective view of the same block as FIG. 4 without the hub.
Figure 8:
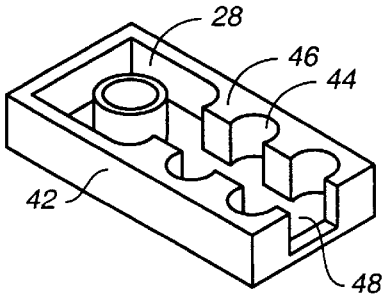
FIG. 8 is a perspective view of the same block as FIG. 7 without the hub.
Figure 11A:
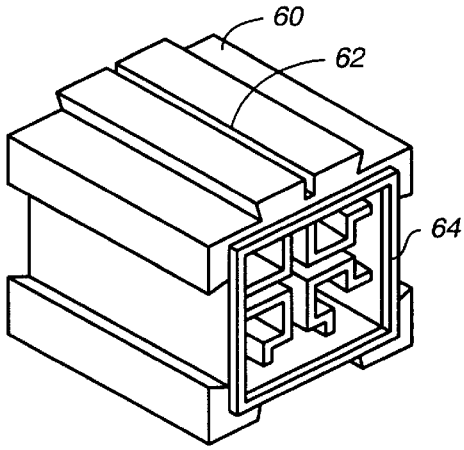
FIG. 11A (PRIOR ART)
FIGS. 11*a* and 11*b* are bottom and top perspective views of a construction block toy with craft stick (spoke) connection means as described in Paul T. Maddock's U.S. Pat. No. 5,527,201, Jun. 18, 1996.
Figure 9:
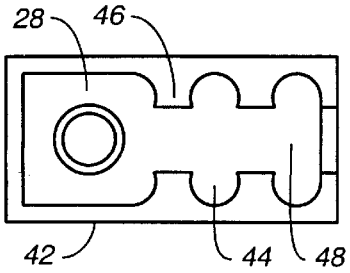
FIG. 9 is a bottom view of the same block as FIGS. 7 and 8.
Figure 11B:
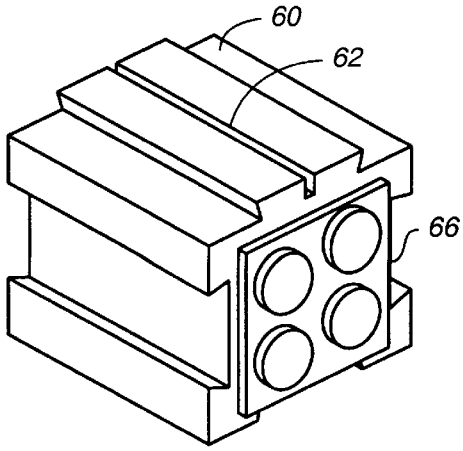
FIG. 11B (PRIOR ART)

FIGS. 2, 5 and 8 show three versions of my invention. FIGS. 1, 4 and 7 show a hub 40 inserted into channels 24, 36 and 48. The width, length and height of base blocks 20, 30 and 42 are consistent with other blocks of this well-known construction toy. These versions of my invention fit easily into structures built with this type of toy.

Here is the basic operation of my invention, describing how to interconnect different types of construction toys:

1. A base (20, 30 and 42) connects on several surfaces with construction block toys of a well-known type.

2. A hub 40 slides into a channel (24, 36 or 48) formed by gripping means (22, 34 or 46).

3. Spokes and hubs from a well-known hub and spoke toy connect to hub 40 in channel 24, 36 or 48. Gripping means 22, 34 or 46 grip hub 40 with sufficient force.

4. One adjusts the placement of hub 40 to match the spacing requirements of the different toys. In this manner the two different types of well-known construction toys interconnect.

Gripper posts 22 and gripper arms 34, 46 do not lock hubs 40 into one position, but instead allow for variable placement. The placements of hub 40 is continuously variable along the length and height of the channel. This accommodates the different pitches or basic units of the two different types of construction toys.

Figure 12B:
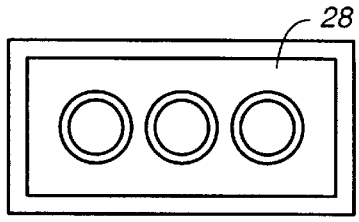
FIG. 12B (PRIOR ART)
FIG. 12*b* is a bottom view of a well-known block type construction toy.
Figure 12C:
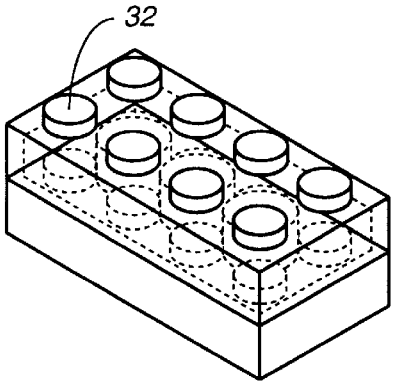
FIG. 12C (PRIOR ART)
FIG. 12*c* is a typical assembled set of prior art block toys illustrated in FIGS. 12*a* and 12*b*.

In FIG. 12*c*, a block-type toy system with the block toy of FIG. 12*b* placed atop the block toy of FIG. 12*a*, or two identical block toys of FIG. 12*a*, one atop the other is illustrative of an assembled set of prior art block toys of the LEGO type. LEGO is a registered trademark of Interlego AG.

Figure 13A:
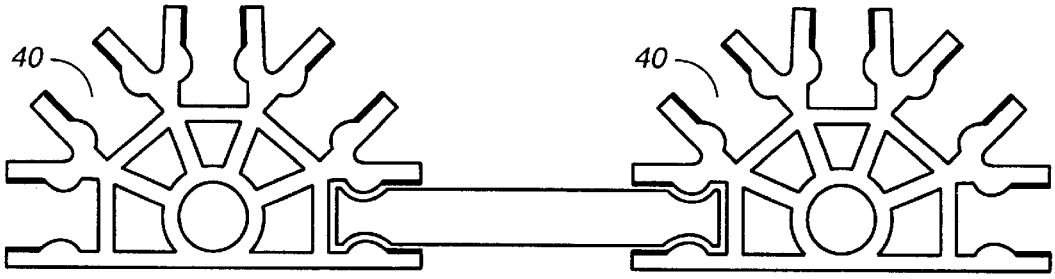
FIG. 13A (PRIOR ART)
FIG. 13*a* is a typical assembled set of prior art hub and spoke toys of the type shown in FIG. 13, with two identical hubs being joined by one spoke.

In FIG. 13*a*, two identical hubs of the type shown in FIG., 13 of a hub and spoke toy, have a spoke joining two spoke sockets of respective hubs. This is illustrative of an assembled set of prior art hub and spoke toys of the K'NEX type. K'NEX is a registered trademark of K'NEX Industries, Inc.

I claim:

1. A construction toy system allowing connection of first and second sets of construction toys comprising:

a first set of block toys with blocks having posts and recesses for receiving posts of other blocks, with a multiplicity of possible ways of connecting blocks of the first set, a second set of hub and spoke toys with said hubs having a planar base and a plurality of spoke sockets in multiple radial directions relative to the planar base, with a multiplicity of possible ways of connecting hubs of the second set, and a set of connector pieces with each piece having posts and recesses for joining with posts and recesses of blocks of the first set of block toys, said connector pieces having surfaces defining channels accepting the planar bases of the second set of hub and spoke toys, the channels permitting sliding of the planar bases of the hubs in the channels, whereby connected hubs of the second set of toys may be spatially adjusted relative to blocks of the first set of toys while maintaining connections of blocks and hubs of each respective toy set.

2. The toy system of claim 1 wherein said channels are defined by grooves in said surfaces of the connector pieces.

3. The toy system of claim 1 wherein said channels are defined between posts in the block toys, said posts split to have facing sides aligned and spaced apart to form grooves receiving the planar bases of the hub and spoke toys.

4. In a construction toy system allowing connection of a first set of toys having blocks with a second set of toys having hubs wherein some blocks of the block toys have posts mating with recesses of other blocks and the hubs have a planar base with radial spoke sockets extending in multiple radial directions, the connector toy comprising, a connector block (28) having posts (22) and recesses spaced to join blocks of the first set of toys and further having a channel (24) accommodating the planar base associated with the hubs (40), the channel defined between posts in the connector block, the posts (22) having facing sides (26) aligned and spaced apart by an extent to seat the base of a hub (40) allowing sliding of hubs (40) in connector block (28) whereby the connector block permits spatial adjustment of hubs (40) of the second set of toys to blocks of the first set of toys.

* * * * *